US007610709B2

(12) United States Patent
Eith et al.

(10) Patent No.: US 7,610,709 B2
(45) Date of Patent: Nov. 3, 2009

(54) ANTIDISMANTLING DEVICE FOR HAND-GUNS

(75) Inventors: Stefan Eith, Neu-Ulm (DE); Wulf-Heinz Pflaumer, Arnsberg (DE); Franz Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 0 days.

(21) Appl. No.: 12/223,547

(22) PCT Filed: Jan. 26, 2007

(86) PCT No.: PCT/DE2007/000145

§ 371 (c)(1),
(2), (4) Date: Oct. 15, 2008

(87) PCT Pub. No.: WO2007/087787

PCT Pub. Date: Aug. 9, 2007

(65) Prior Publication Data

US 2009/0217564 A1 Sep. 3, 2009

(30) Foreign Application Priority Data

Feb. 4, 2006 (DE) ..... 20 2006 001 769 U

(51) Int. Cl.
*F41A 9/53* (2006.01)

(52) U.S. Cl. ..... 42/1.05; 42/70.01; 42/75.01

(58) Field of Classification Search ..... 42/1.05, 42/70.01, 75.01

See application file for complete search history.

(56) References Cited

U.S. PATENT DOCUMENTS

| | | | | |
|---|---|---|---|---|
| 439,551 | A | 10/1890 | Pheatt | |
| 1,805,383 | A | 5/1931 | Thiry | |
| 1,992,934 | A | 3/1935 | Bamberger | |
| 3,745,881 | A * | 7/1973 | Roy | 89/163 |
| 4,103,639 | A | 8/1978 | Otteson | |
| 4,494,329 | A * | 1/1985 | Post et al. | 42/1.05 |
| 6,263,607 | B1 | 7/2001 | Fuchs et al. | |
| 6,857,213 | B2 * | 2/2005 | Fluhr | 42/1.05 |

FOREIGN PATENT DOCUMENTS

| | | |
|---|---|---|
| DE | 33 05 773 | 9/1983 |
| DE | 20 2004 016 026 | 1/2005 |
| EP | 1 022 534 | 7/2000 |

* cited by examiner

*Primary Examiner*—J. Woodrow Eldred
(74) *Attorney, Agent, or Firm*—Collard & Roe, P.C.

(57) ABSTRACT

An antidismantling device for preventing dismantling of a hand-gun when a cartridge is present in the barrel (102) of the hand-gun, the barrel (102) being mounted in a breech block (110), and a guide pin (123), which is biased at least indirectly in the direction of the longitudinal axis of the barrel (102), is slidably mounted in a bearing (113) in the breech block (110), and one end of the guide pin at least indirectly abuts a contact surface (121) for making contact with part of a cartridge (101), and the position of the guide pin in relation to the breech block (110) when a cartridge (101) is present in the barrel (102) differs from the position thereof assumed in the absence of a cartridge (101) in the barrel (102) is created in that the guide pin (123) interacts at least indirectly with a safety mechanism (141) provided on the grip of the hand-gun in order to prevent dismantling of the breech block (110) when a cartridge (101) is present in the barrel (102) of the handgun.

14 Claims, 6 Drawing Sheets

ANTIDISMANTLING DEVICE FOR HAND-GUNS

CROSS REFERENCE TO RELATED APPLICATIONS

This application is the National Stage of PCT/DE2007/000145 filed on Jan. 26, 2007, which claims priority under 35 U.S.C. §119 of DE 20 2006 001 769.0 filed on Feb. 4, 2006. The international application under PCT article 21(2) was not published in English.

The present invention relates to an antidismantling device for preventing dismantling of a hand-gun when a cartridge is present in the hand-gun barrel mounted in a breech block in which a guide pin, which is at least indirectly biased in the direction of the longitudinal axis of the barrel, is slidably mounted in a bearing in the breech block, and one end of the guide pin at least indirectly abuts a contact surface for making contact with part of a cartridge, while the position of said guide pin in relation to the breech block when a cartridge is present in the barrel differs from the position thereof assumed when no cartridge is present in the barrel.

Dismantling devices and dismantling mechanisms that enable a hand-gun breech block to be removed completely from the grip of a hand-gun are known in the prior art. Usually, this requires manual actuation of a special dismantling lever. However, a safety mechanism offering greater safety in that it permits manual dismantling of the hand-gun only when the condition is met that no cartridge is inserted in the hand-gun barrel, is unknown in the prior art.

It is therefore an object of the present invention to provide an antidismantling device which reliably prevents dismantling of a hand-gun in the sense of disassembly thereof when a cartridge is present in the hand-gun barrel.

This object is achieved for an antidismantling device of the type mentioned above in that the guide pin at least indirectly interacts with a safety mechanism provided on the grip of the hand-gun in order to prevent dismantling of the breech block when a cartridge is present in the barrel of the hand-gun.

Preferred embodiments of the invention are the subject matter of the subordinate claims.

In the device of the invention, the combination of features, namely the at least indirect interaction of the guide pin with a safety mechanism provided on the grip of the hand-gun in order to prevent dismantling of the breech block when a cartridge is present in the barrel of the hand-gun, results in the creation of a reciprocatable mechanical coupling of one element in the form of one end of the guide pin engaging a cartridge located in the hand-gun barrel, with another element, this being in the form of another part of the guide pin or another component moved by the guide pin and optionally totally obstructing movement of the breech block along the breech block guide, thereby automatically obstructing the breech block guide when a cartridge is present in the hand-gun barrel. This ensures additional safety when handling the hand-gun.

According to a first preferred embodiment of the device of the invention, provision is made for the safety mechanism to be formed by a guide device of the hand-gun provided on a grip of the hand-gun and aligned parallel to the longitudinal axis of the breech block.

According to an important preferred embodiment of the device of the invention, a recess is provided in the vicinity of the other end of the guide pin, which recess is dimensioned such that the guide mechanism can be inserted into the recess only in the absence of a cartridge in the barrel. In general, the guide mechanism is preferably formed by the breech block guide of the hand-gun.

Furthermore, the guide pin can be connected to a contact element, on which the contact surface for making contact with part of a cartridge is formed. In particular, the contact element can be formed as a pin, which is at a predefined angle in relation to the guide pin and is mounted in a bearing of the breech block in such a way that the free end of the guide pin is disposed in the region of a lateral surface of the breech block. The angle preferably ranges from about 35° to 65°.

According to another preferred embodiment of the device of the invention, the guide pin comprises a bearing surface for interacting with a pressure piece, which is spring-biased so as to urge the indicator element and thus the contact element in the direction of the longitudinal axis of the barrel.

In general, the breech block guide is preferably formed in such a way that a subregion thereof comprises a shift gate for interacting with the free end of the guide pin.

When the guide pin is designed with a recess, the latter is preferably moved in such a way in the presence of a cartridge in the barrel that the free end of the guide pin obstructs insertion of the guide mechanism and prevents removal of the breech block. In this case, a portion of the breech block guide preferably comprises a shift gate acting as a safety device for interaction with the recess in the guide pin.

According to another preferred embodiment of the device of the invention, the contact element is disposed in an upper region of the breech block and is mounted in such a way that, when a cartridge is in the barrel, the contact element projects from that region of the surface of the breech block that is centrally disposed in relation to the lateral surfaces of the breech block in order to act as an optical and/or tactile indicator element for indicating the presence of a cartridge in the barrel. The indicator element is preferably guided at least partly in a recess of the barrel. The indicator element, the contact element, and the guide pin are preferably formed as a single piece.

The device of the invention will be explained below with reference to a preferred embodiment illustrated in the figures of the drawing, in which.

Figure 1:
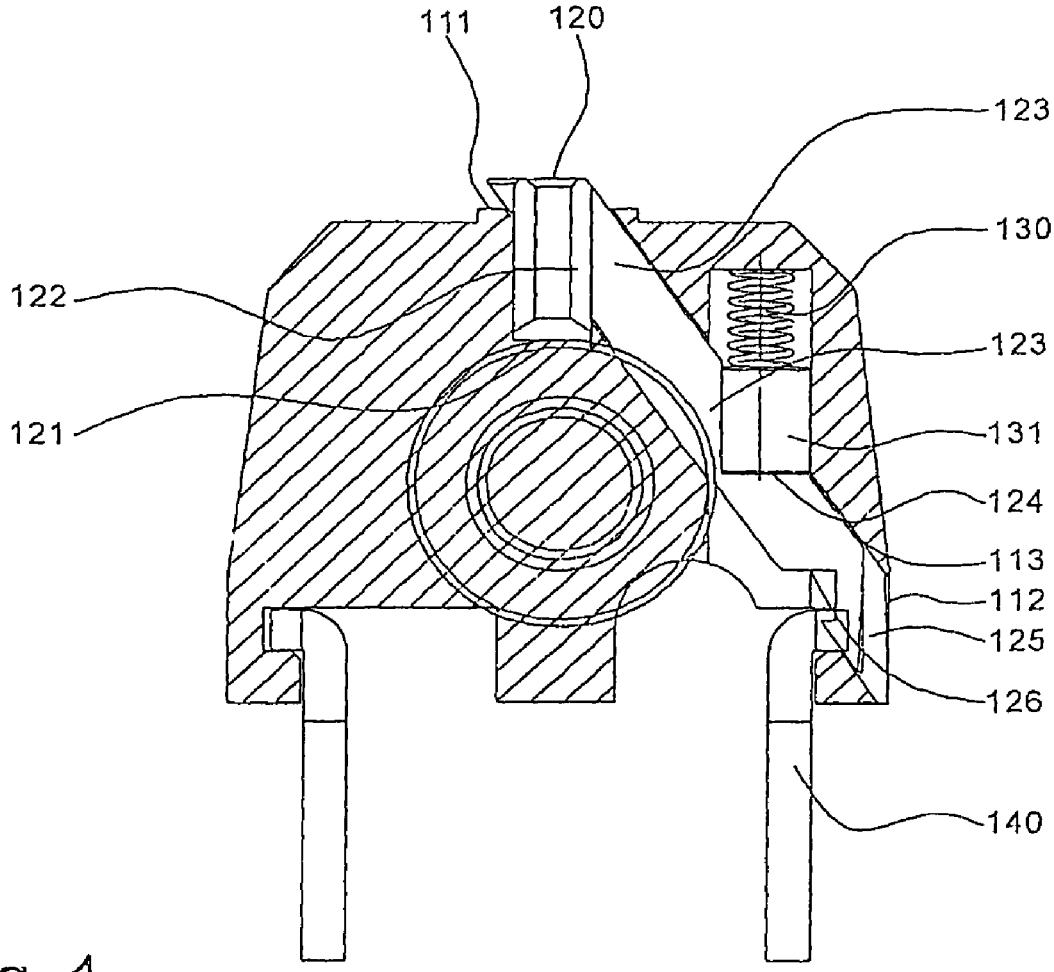
FIG. 1 is a longitudinal section of a preferred embodiment of the safety device of the invention with a cartridge being present in the barrel.
Figure 2:
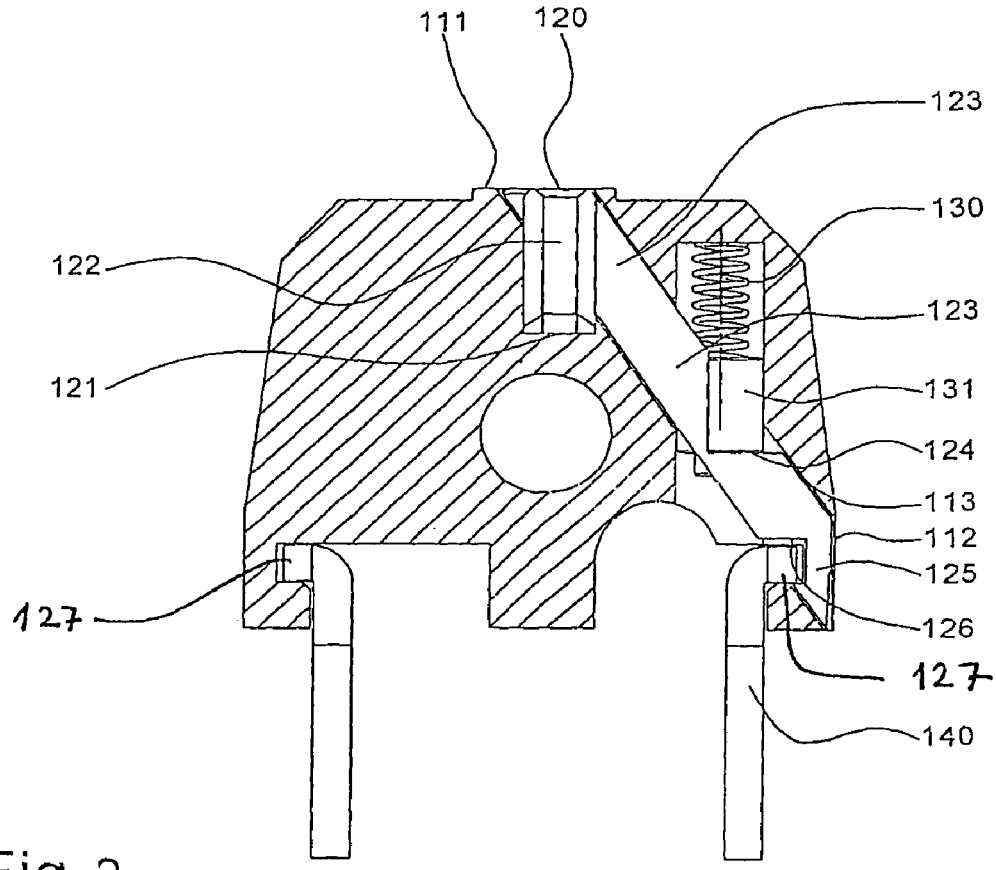
FIG. 2 is a longitudinal section of a preferred embodiment of the device of the invention with no cartridge being present in the barrel.
Figure 3:
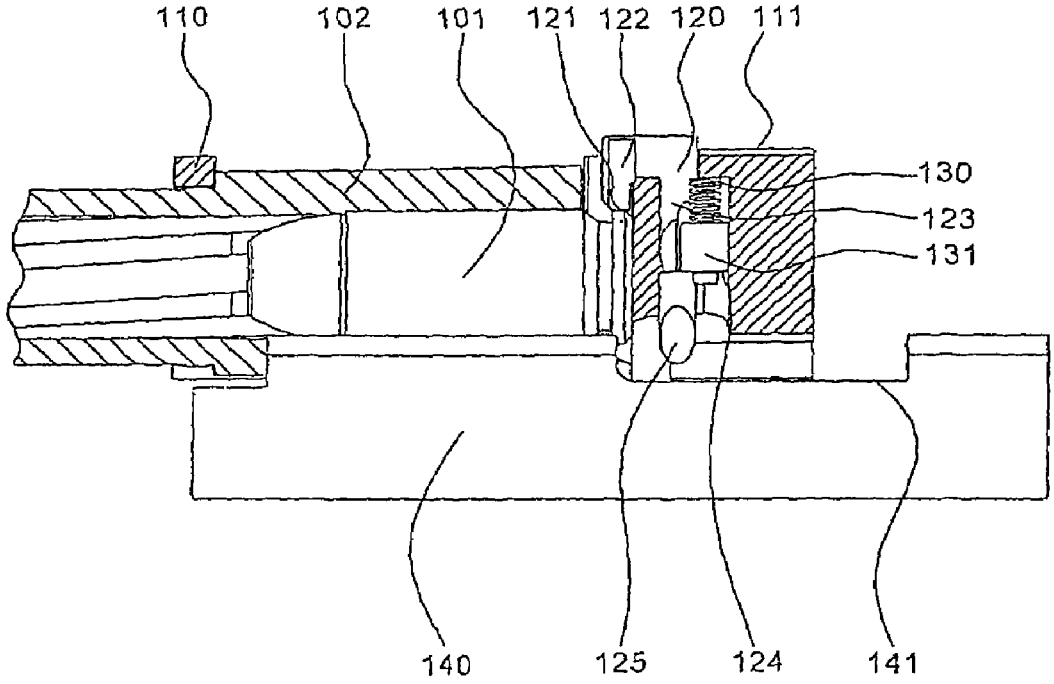
FIG. 3 is a cross-section of the preferred embodiment of the device of the invention shown in FIG. 1 with a cartridge being present in the barrel.
Figure 4:
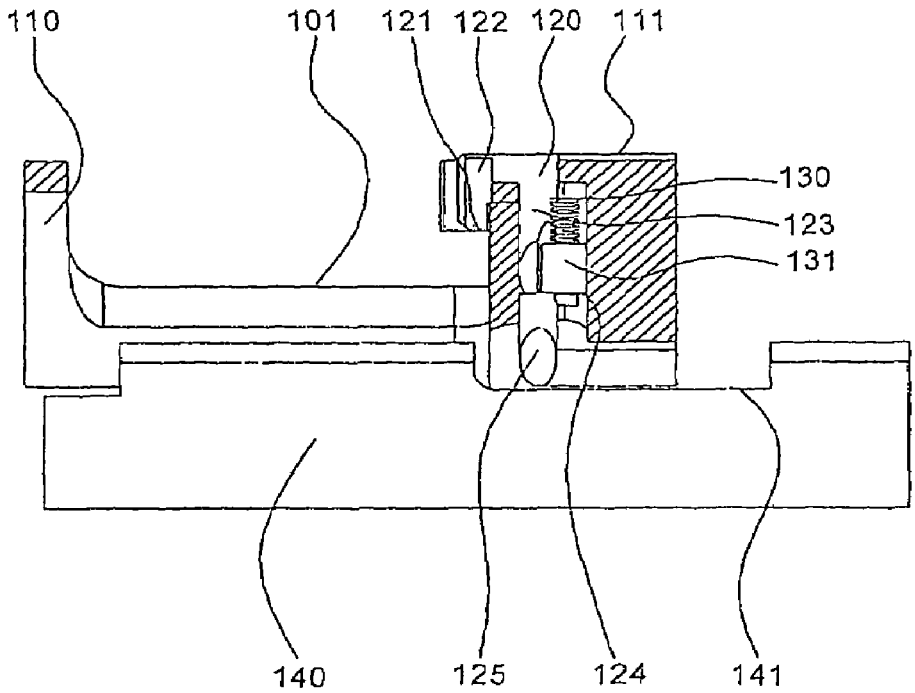
FIG. 4 is a cross-section of the preferred embodiment of the device of the invention shown in FIG. 1 with no cartridge being present in the barrel.
Figure 5:
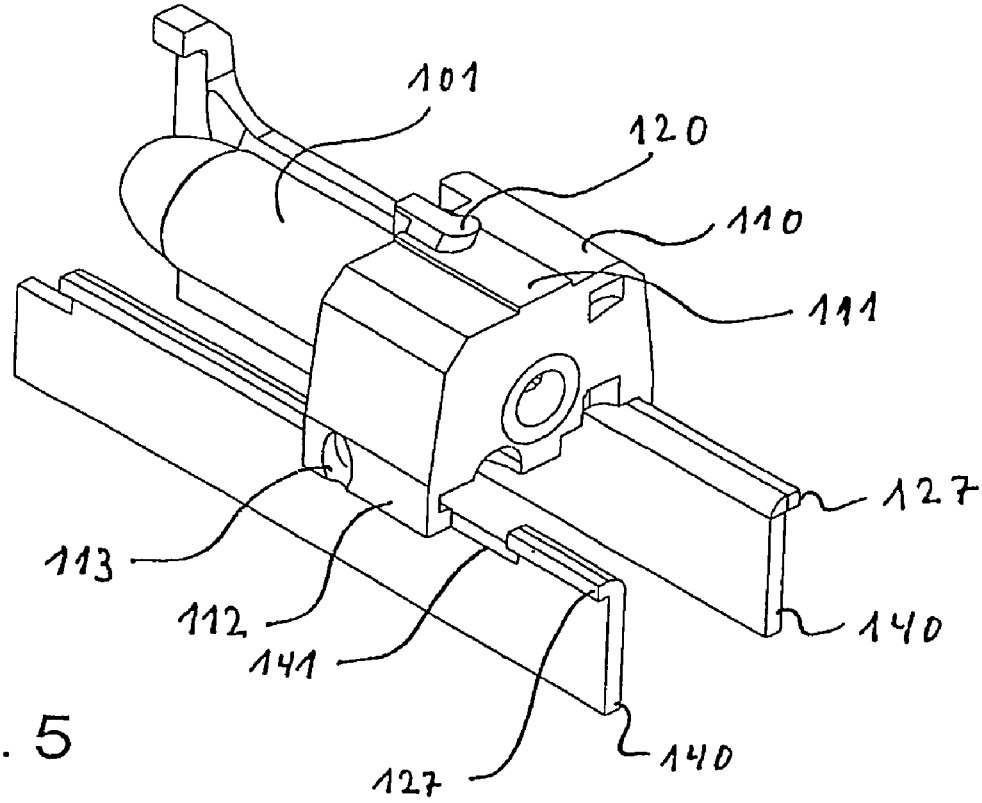
FIG. 5 shows the preferred embodiment of the device of the invention shown in FIG. 1, as viewed obliquely from above.
Figure 6:
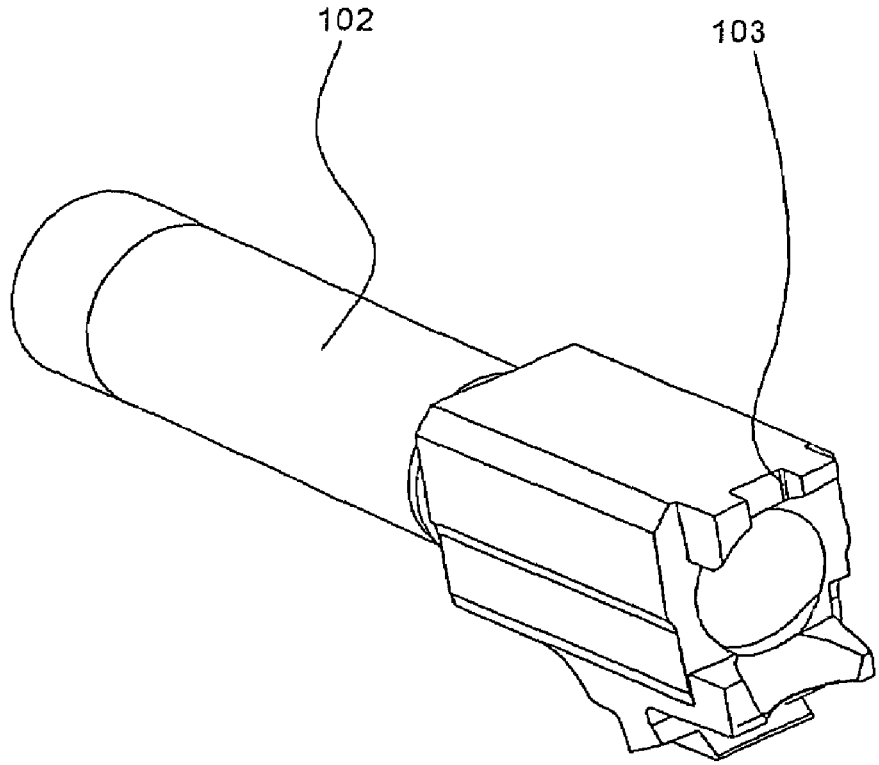
FIG. 6 shows a preferred embodiment of the device of the invention shown in FIG. 1, as viewed obliquely from above, with a breech block guide formed on the gun, a subregion of said guide being provided with a shift gate.

The antidismantling device of the invention shown in FIGS. 1 to 6 is effective in preventing dismantling of a hand-gun when a cartridge is present in the barrel 102 of the hand-gun, said barrel 102 being mounted in a breech block 110, and a guide pin 123, which is biased at least indirectly in the direction of the longitudinal axis of the barrel 102, is slidably mounted in a bearing 113 in the breech block 110, and one end of the guide pin at least indirectly abuts a contact surface 121 for making contact with part of a cartridge 101, and the position of said guide pin in relation to the breech block 110 when a cartridge 101 is present in the barrel 102 differs from the position thereof assumed in the absence of a cartridge 101 in the barrel 102. The essential feature of the invention is that the guide pin 123 interacts at least indirectly with a safety mechanism 141 provided on the grip of the hand-gun in order to prevent dismantling of the breech block 110 when a cartridge 101 is present in the barrel 102 of the hand-gun.

The safety device 141 is formed by a guide means 127 of the hand-gun provided on a grip of the hand-gun and aligned parallel to the longitudinal axis of the breech block 110 and formed on the breech block guide 140 of the hand-gun. A recess 126 is provided near the other end 125 of the guide pin 123, which recess is dimensioned in such a way that the guide means 127 can be inserted in the recess only in the absence of a cartridge 101 in the barrel 102.

The guide pin 123 is connected to a contact element 122, on which the contact surface 121 that makes contact with part of a cartridge 101 is formed. The contact element 122 is in the form of a pin, which is at a predefined angle of 45° in relation to the guide pin 123 and is mounted in a bearing 113 of the breech block 110 in such a way that the free end 125 of the guide pin is disposed in the region of a lateral surface 112 of the breech block.

The guide pin 123 comprises a bearing surface 124 for functioning coactively with a pressure piece 131, which is biased by a spring 130 and which urges the indicator element 120 and thus the contact element 122 in the direction of the longitudinal axis of the barrel 102. The recess of the guide pin 123 is preferably moved in such a way that, when a cartridge 101 is present in the barrel 102, the free end 125 of the guide pin 123 obstructs insertion of the guide means 127 and prevents removal of the breech block 110.

A subregion of the breech block guide 140 comprises a shift gate 141 acting as a safety device for interaction with the recess 126 in the guide pin 123.

A contact element 122 is disposed in an upper region of the breech block 110 and is mounted such that when a cartridge 101 is present in the barrel 102, the contact element projects from that region of the surface 111 of the breech block that is centrally disposed in relation to the lateral surfaces 112 of the breech block, in order to act as an optical and/or tactile indicator element 120 for indicating the presence of a cartridge 101 in the barrel 102. The indicator element 120 is preferably guided at least partly in a recess 103 of the barrel 102 and is formed with the contact element 122 and the guide pin 123 as a single piece.

The exemplary embodiment of the invention described above merely serves to provide better understanding of the teaching of the invention defined in the claims. The teaching of the invention is not, as such, limited to the exemplary embodiment.

The invention claimed is:

1. An antidismantling device for preventing dismantling of a hand-gun when a cartridge is present in the barrel (102) of the hand-gun, said barrel (102) being mounted in a breech block (110), and a sensor element (123), which is biased at least indirectly in the direction of the longitudinal axis (143) of the barrel (102), is located in the breech block (110) and comprises in the region of one end thereof at least indirectly a contact surface (121) for making contact with part of a cartridge (101) and assumes a position in relation to the breech block (110) when a cartridge (101) is present in the barrel (102) which differs from the position thereof assumed in the absence of a cartridge (101) in the barrel (102) and the sensor element (123) interacts at least indirectly with a safety mechanism (141) provided on the grip of the hand-gun in order to prevent dismantling of the breech block (110) when a cartridge (101) is present in the barrel (102) of the hand-gun wherein the sensor element is in the form of a guide pin which is biased at least indirectly in the direction of the longitudinal axis of the barrel and is slidably mounted in a bearing in the breech block, and one end of the guide pin at least indirectly abuts a contact surface for making contact with part of a cartridge and the guide pin (123) comprises a bearing surface (124) for functioning coactively with a pressure piece (131), which is biased by a spring (130) and which urges the indicator element (120) and thus the contact element (122) in the direction of the longitudinal axis of the barrel (102).

2. The device as defined in claim 1, wherein the safety device (141) is formed by a guide means (127) of the hand-gun provided on a grip of the hand-gun and aligned parallel to the longitudinal axis of the breech block (110) and formed on the breech block guide (140) of the hand-gun.

3. The device as defined in claim 2, wherein a recess (126) is provided near the other end (125) of the guide pin (123), which recess is dimensioned in such a way that the guide means (127) can be inserted in the recess only in the absence of a cartridge (101) in the barrel (102).

4. The device as defined in claim 2, wherein the guide means (127) is formed by the breech block guide (140) of the gun.

5. The device as defined in claim 3, wherein the guide pin (123) is connected to a contact element (122), on which the contact surface (121) that makes contact with part of a cartridge (101) is formed.

6. The device as defined in claim 5, wherein the contact element (122) is in the form of a pin which is at a predefined angle in relation to the guide pin (123) and is mounted in a bearing (113) of the breech block (110) in such a way that its free end (125) is disposed in the region of a lateral surface 112 of the breech block.

7. The device as defined in claim 6, wherein said angle is from approx. 35° to 65°.

8. The device as defined in claim 1, wherein the guide pin (123) comprises a bearing surface (124) for functioning coactively with a pressure piece (131), which is biased by a spring (130) and which urges the indicator element (120) and thus the contact element (122) in the direction of the longitudinal axis of the barrel (102).

9. The device as defined in claim 3, wherein the recess of the guide pin (123) is preferably moved in such a way that, when a cartridge (101) is present in the barrel (102), the free end (125) of the guide pin (123) obstructs insertion of the guide means (127) and prevents removal of the breech block (110).

10. The device as defined in claim 6, wherein a subregion of the breech block guide (140) comprises a shift gate (141) acting as a safety device for interaction with the free end (125) of the guide pin (123).

11. The device as defined in claim 6, wherein a subregion of the breech block guide (140) comprises a shift gate (141) for interaction with the recess (126) in the guide pin (123).

12. The device as defined in claim 5, wherein a contact element (122) is disposed in an upper region of the breech block (110) and is mounted such that when a cartridge (101) is present in the barrel (102), the contact element projects from that region of the surface (111) of the breech block that is centrally disposed in relation to the lateral surfaces (112) of the breech block, in order to act as an optical and/or tactile indicator element (120) for indicating the presence of a cartridge (101) in the barrel (102).

13. The device as defined in claim 12, wherein the indicator element (120) is guided at least partly in a recess (103) of the barrel (102).

14. The device as defined in claim 12, wherein the indicator element (120), the contact element (122), and the guide pin (123) are formed as a single piece.

* * * * *